US009347447B2

(12) United States Patent
Mitsuhashi et al.

(10) Patent No.: US 9,347,447 B2
(45) Date of Patent: May 24, 2016

(54) PROCESS FOR MANUFACTURING CASING, AND VACUUM PUMP

(75) Inventors: Yoshihiro Mitsuhashi, Tokyo (JP); Shinichi Kusanagi, Tokyo (JP)

(73) Assignee: NABTESCO AUTOMOTIVE CORPORATION, Tokyo (JP)

( * ) Notice: Subject to any disclaimer, the term of this patent is extended or adjusted under 35 U.S.C. 154(b) by 243 days.

(21) Appl. No.: 13/984,165

(22) PCT Filed: Feb. 10, 2012

(86) PCT No.: PCT/JP2012/053138

§ 371 (c)(1),
(2), (4) Date: Oct. 29, 2013

(87) PCT Pub. No.: WO2012/111561

PCT Pub. Date: Aug. 23, 2012

(65) Prior Publication Data

US 2014/0044583 A1 Feb. 13, 2014

(30) Foreign Application Priority Data

Feb. 14, 2011 (JP) ..... 2011-028481

(51) Int. Cl.
*F04C 29/00* (2006.01)
*F01C 21/10* (2006.01)
(Continued)

(52) U.S. Cl.
CPC ..... *F04C 29/00* (2013.01); *F01C 21/10* (2013.01); *F04C 18/3442* (2013.01); *F04C 25/02* (2013.01); *F04C 2230/21* (2013.01);
(Continued)

(58) Field of Classification Search
CPC .. F04C 29/00; F04C 18/3442; F04C 2230/91; F04C 2250/10; F04C 2230/21; F04C 2240/802; F04C 25/02; F01C 21/10
See application file for complete search history.

(56) References Cited

U.S. PATENT DOCUMENTS 4,776,074 A 10/1988 Suzuki et al.
7,273,029 B2 * 9/2007 Oda et al. ..... 123/193.2
(Continued)

FOREIGN PATENT DOCUMENTS

JP 63-018195 A 1/1988
JP 1-105065 U 7/1989
(Continued)

OTHER PUBLICATIONS

Translation of the International Preliminary Report on Patentability (Form PCT/IB/338) of International Patent Application No. PCT/JP2012/053138, mailing date of Aug. 29, 2013, with forms PCT/IB/373 and PCT/ISA/237.
(Continued)

*Primary Examiner* — Richard Chang
(74) *Attorney, Agent, or Firm* — Westerman, Hattori, Daniels & Adrian, LLP

(57) ABSTRACT

Damage of a rotor and a side plate are suppressed with a simple construction to prevent reduction in durability of a vacuum pump. A casing manufacturing method comprises a step (step S2) of disposing a cylinder liner forming a cylinder chamber in a mold, and casting a casing main body integrally with the cylinder liner by using molten metal, and a step (step S3) of processing an intercommunication hole and an exhaust hole so that the intercommunication hole and the exhaust hole penetrate through both the cylinder liner and the casing main body together and intercommunicate with the cylinder chamber.

5 Claims, 5 Drawing Sheets

(51) Int. Cl.
*F04C 18/344* (2006.01)
*F04C 25/02* (2006.01)

(52) U.S. Cl.
CPC ..... *F04C 2230/91* (2013.01); *F04C 2240/802* (2013.01); *F04C 2250/10* (2013.01)

(56) References Cited

U.S. PATENT DOCUMENTS

| | | | | |
|---|---|---|---|---|
| 2001/0004498 | A1 | 6/2001 | Saito | |
| 2004/0261971 | A1* | 12/2004 | Matsumoto et al. | 164/98 |
| 2007/0041860 | A1 | 2/2007 | Nakamoto et al. | |
| 2008/0245320 | A1* | 10/2008 | Ishikawa | 123/41.74 |
| 2010/0059012 | A1 | 3/2010 | Tachibana et al. | |

FOREIGN PATENT DOCUMENTS

| | | | |
|---|---|---|---|
| JP | 2001-170755 | A | 6/2001 |
| JP | 2003-222090 | A | 8/2003 |
| JP | 2008-196346 | A | 8/2008 |
| JP | 2008-545096 | A | 12/2008 |
| JP | 2009-091973 | A | 4/2009 |
| JP | 2010-059909 | A | 3/2010 |
| WO | 2004/111460 | A1 | 12/2004 |
| WO | 2007/006666 | A1 | 1/2007 |

OTHER PUBLICATIONS

Office Action dated Apr. 20, 2015, issued in corresponding Chinese Patent Application No. 201280008904.8, with English translation (18 pages).

Decision of Rejection dated Mar. 24, 2015, issued in corresponding Japanese Patent Application No. 2011-028481, with English translation (7 pages).

International Search Report for PCT/JP2012/053138, Mailing Date of Apr. 24, 2012.

Written Opinion for PCT/JP2012/053138, Mailing Date of Apr. 24, 2012.

Office Action dated Dec. 30, 2015, issued in counterpart Chinese Patent Application No. 201280008904.8, with English translation. (16 pages).

* cited by examiner

PROCESS FOR MANUFACTURING CASING, AND VACUUM PUMP

TECHNICAL FIELD

The present invention relates to a method of manufacturing a casing having a cylinder chamber in which a rotational compression element driven by a driving machine slides, and a vacuum pump having the casing.

BACKGROUND ART

There is generally known a vacuum pump having a casing secured to a driving machine such as an electrically-operated motor or the like and a rotational compression element rotated by the driving machine in a cylinder chamber of the casing. In this type vacuum pump, the rotational compression element is driven in the cylinder chamber by the driving machine to obtain vacuum. For example, the vacuum pump is mounted in an engine room of a vehicle and used to generate vacuum for actuating a brake booster (see Patent Document 1, for example).

PRIOR ART DOCUMENT

Patent Document

Patent Document 1: JP-A-2003-222090

SUMMARY OF THE INVENTION

Problem to be Solved by the Invention

Therefore, this type of vacuum pump has been required to be miniaturized because it is impossible to secure a large mount space for the vacuum pump. For example, it is considered that a cylinder liner forming a cylinder chamber is pressed into the main body of the casing to reduce the dimension of the casing in the relational shaft direction.

However, with respect to this construction, it is required to manufacture a cylinder liner that has an intake hole and an exhaust hole processed in the peripheral wall thereof so that the intake hole and the exhaust hole intercommunicate with the cylinder chamber, and is subjected to surface hardening such electroless plating or the like on the inner surface thereof defining the cylinder chamber, and press the thus-manufactured cylinder liner into a hole portion of the casing main body. Therefore, fine adjustment for matching the position of the intake hole or the exhaust hole with a predetermined position of the casing main body is required after the cylinder liner is pressed in. In addition, there is a case where burr occurs at a part of the casing main body due to an edge portion of the intake hole or exhaust hole, which requires an additional step for removing the burr. Therefore, there is a problem that the number of working steps increases.

Therefore, the present invention has an object to provide a method of manufacturing a casing that is miniaturized in the axial direction thereof and can reduce the number of working steps, and a vacuum pump having the casing.

Means of Solving the Problem

In order to attain the above object, according to the present invention, a method of manufacturing a casing having a cylinder chamber in which a rotational compression element driven by a driving machine slides, is characterized by comprising: a step of disposing a cylinder liner forming the cylinder chamber in a mold, and casting a casing main body by using molten metal while integrally incorporating the cylinder liner in the casted casing main body; and a step of processing an intercommunication hole and an exhaust hole that penetrate through the cylinder liner and the casing main body together and intercommunicate with the cylinder chamber.

According to this construction, after the casing main body is casted integrally with the cylinder liner, the intake hole and the exhaust hole are processed so as to penetrate through the cylinder liner and the casing main body as an integrated body and intercommunicate with the cylinder chamber. Therefore, the work of adjusting the hole positions between the cylinder liner and the casing main body and the additional step of the casing main body are not required, and thus the working steps of the manufacturing process can be reduced. Furthermore, the casing is manufactured by casting the casing main body while the cylinder liner is integrated with the casing main body, and thus the casing can be miniaturized in the axial direction thereof.

In this construction, the method further comprises a step of coating harder metal than the cylinder liner on an inner peripheral surface of the cylinder liner in which the intake hole and the exhaust hole are processed is further provided. According to this construction, a sliding surface having high hardness can be simply formed in even the casing in which the casing main body is casted integrally with the cylinder liner.

Furthermore, the method further comprises a step of forming means for preventing rotation and dropout of the cylinder liner on an outer peripheral surface of the cylinder liner prior to the step of casting the casing main body integrally with the cylinder liner. According to this construction, even when metals different in thermal expansion coefficient are adopted for the cylinder liner and the casing main body, the rotation and dropout of the cylinder liner can be more simply prevented as compared with the construction that the cylinder liner is pressed in because the means for preventing rotation and dropout is formed on the outer peripheral surface of the cylinder liner.

Still furthermore, a spiral groove is formed on the outer peripheral surface of the cylinder liner as the means for preventing the rotation and the dropout. According to this construction, the cylinder liner from which rotation and dropout can be prevented can be simply produced.

Still furthermore, according to the present invention, a vacuum pump having a casing secured to a driving machine and a cylinder chamber in which a rotational compression element driven by the driving machine slides, the cylinder chamber being provided in the casing, is characterized in that the casing has a cylinder liner with which a casing main body is casted integrally to form the cylinder chamber, and an intake hole and an exhaust hole that penetrate through the cylinder liner and the casing main body together and intercommunicate with the cylinder chamber.

Effect of the Invention

According to this invention, after the casing main body is casted integrally with the cylinder liner, the intake hole and the exhaust hole are processed so as to penetrate through the cylinder liner and the casing main body integrally and intercommunicate with the cylinder chamber. Therefore, the work of adjusting the hole positions between the cylinder liner and the casing main body and the additional step of the casing main body are not required, and thus the number of working steps of the manufacturing process can be reduced. Furthermore, the casing is manufactured by casing the casing main body integrally with the cylinder liner, so that the casing can be miniaturized in the axial direction.

MODE FOR CARRYING OUT THE INVENTION

A preferable embodiment according to the present invention will be described hereunder with reference to the drawings.

Figure 1:
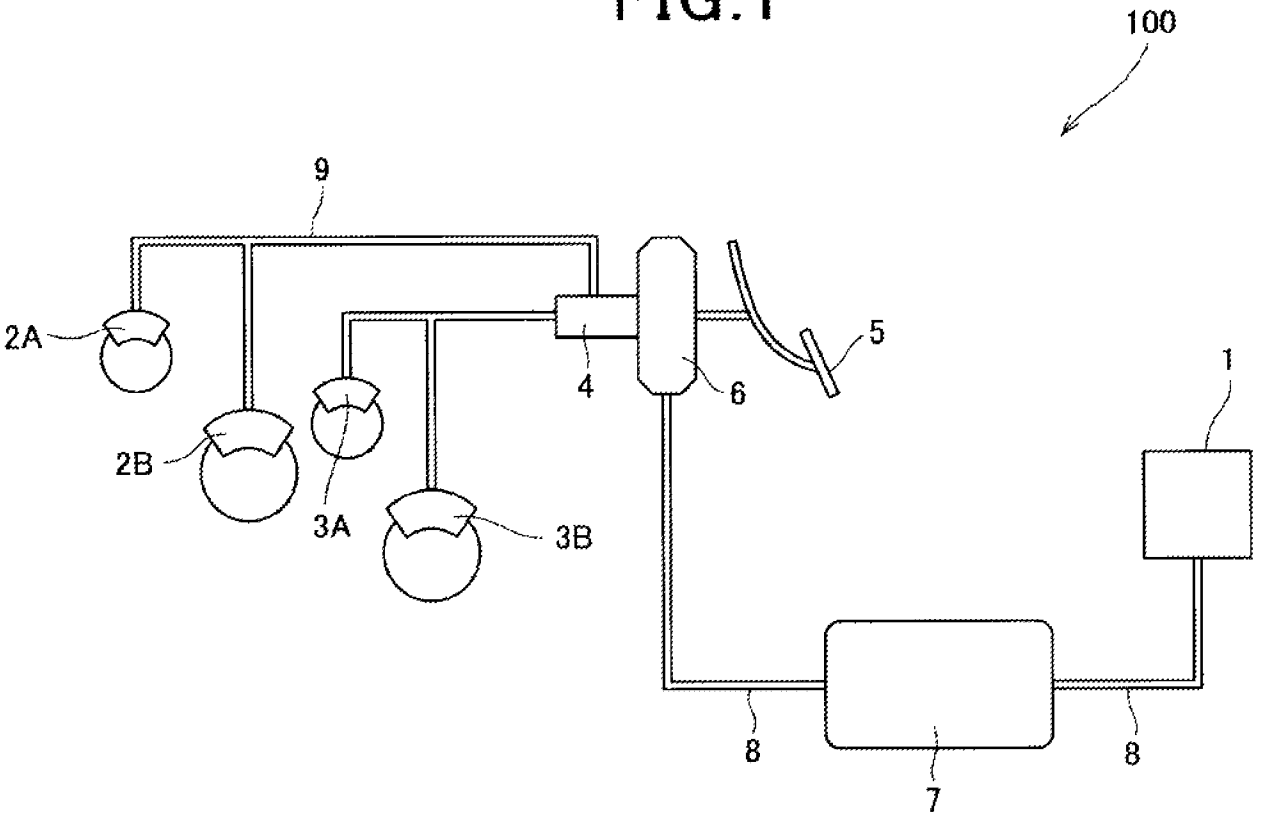
FIG. 1 is a diagram showing a brake device using a vacuum pump according to an embodiment.

FIG. 1 is a diagram showing a brake device 100 using a vacuum pump 1 according to an embodiment of the present invention as a negative pressure source. The brake device 100 has front brakes 2A, 2B secured to the right and left front wheels of a vehicle such as a car or the like, and rear brakes 3A, 3B secured to the right and left rear wheels. Each of the brakes is connected to a master cylinder 4 through a brake pipe 9, and each brake is actuated by hydraulic pressure applied from the master cylinder 4 to the brake pipe 9.

The brake device 100 has a brake booster (brake boosting device) 6 connected to a brake pedal 5, and a vacuum tank 7 and a vacuum pump 1 are connected to the brake booster 6 in series through air pipes 8. The brake booster 6 boosts the tread force of the brake pedal 5 by using negative pressure in the vacuum tank 7, and draws out sufficient braking newer by moving the piston of the master cylinder 4 with small tread force.

The vacuum pump 1 is disposed in the engine room of the vehicle, and evacuates air in the vacuum tank 7 to the outside of the vehicle, whereby the inside of the vacuum tank 7 is set to a vacuum state. The use range of the vacuum pump 1 used for a car or the like is set from −60 kPa to −80 kPa.

Figure 2:
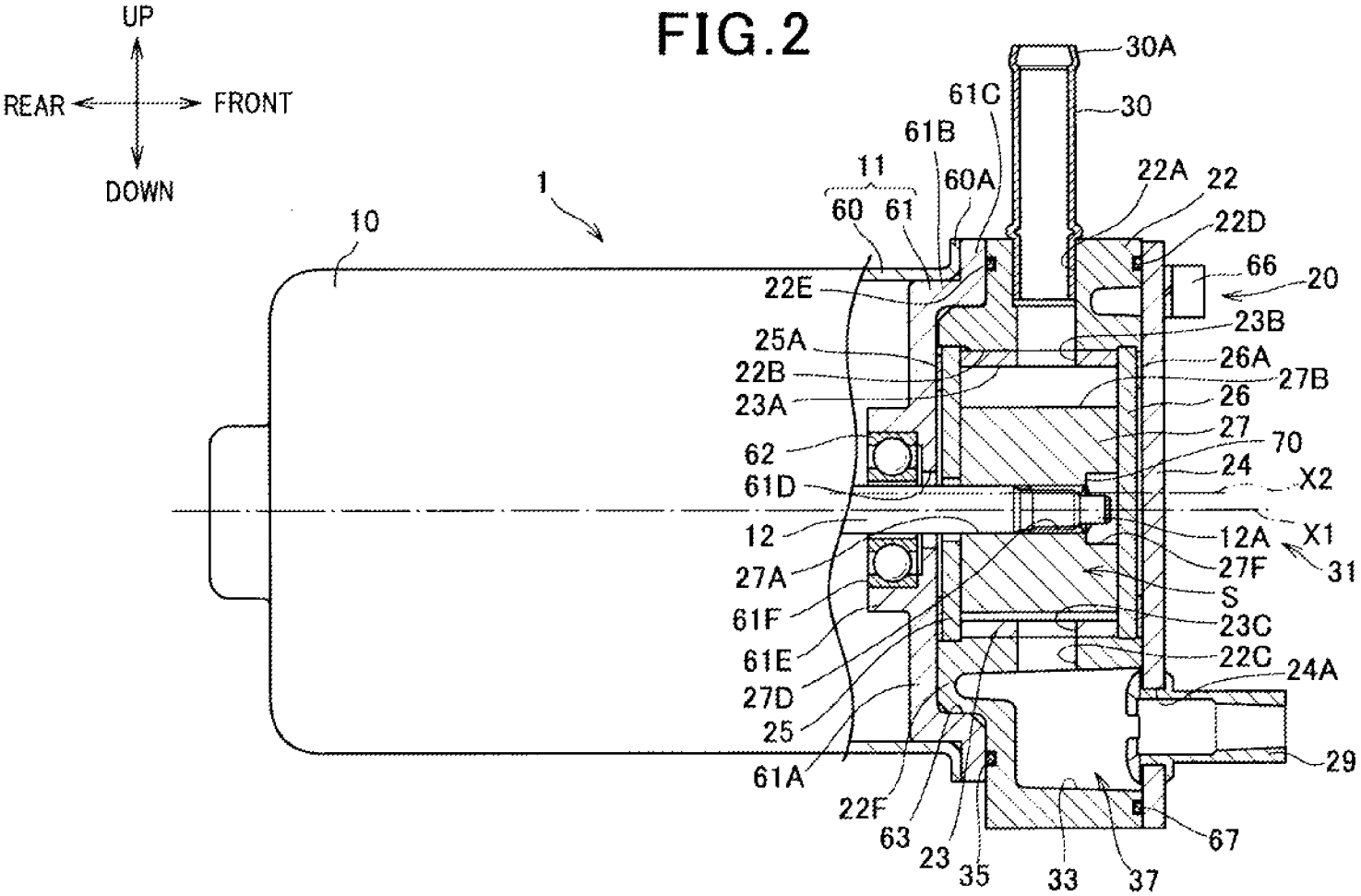
FIG. 2 is a partially cross-sectional view of the side portion of the vacuum pump.
Figure 3:
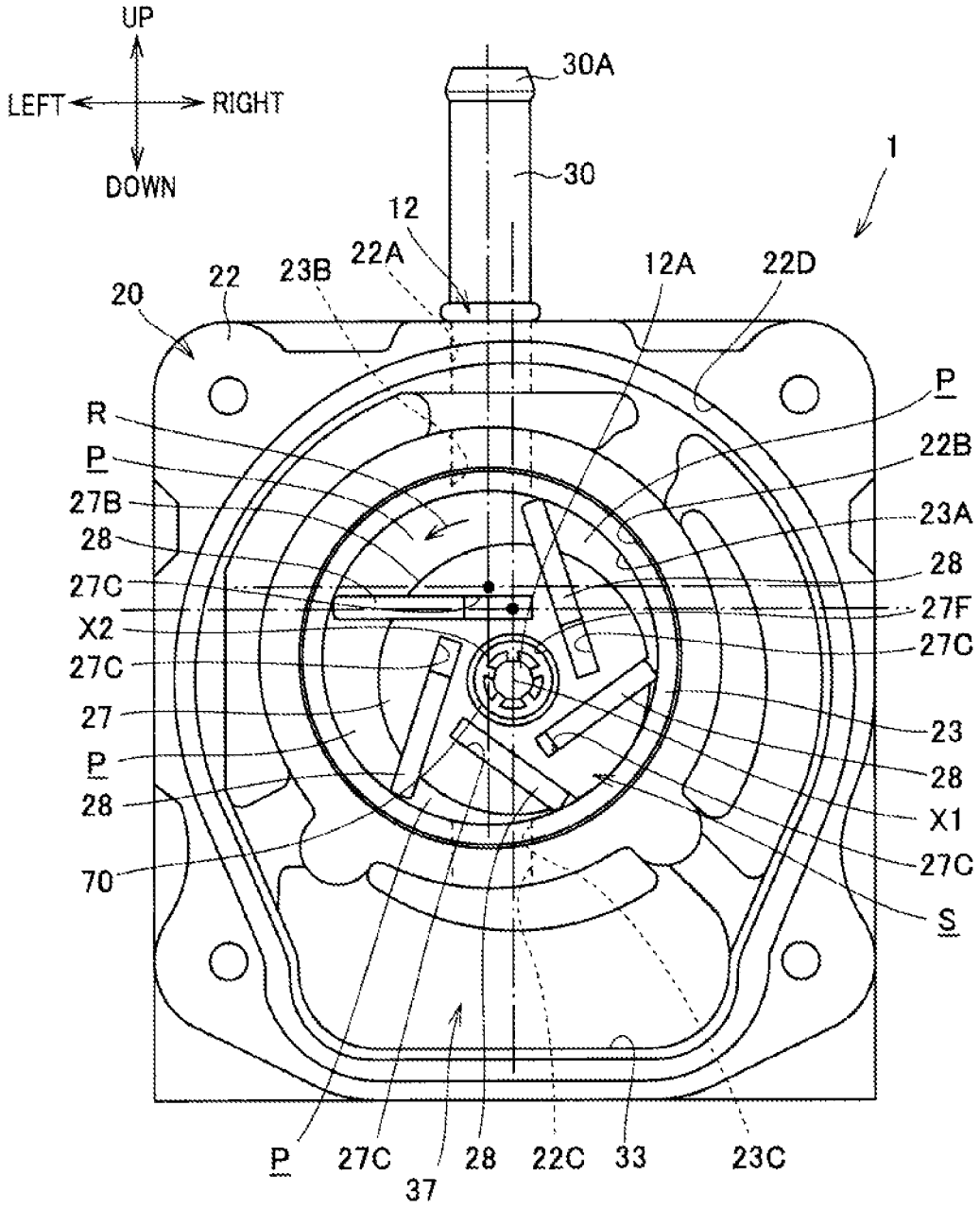
FIG. 3 shows the vacuum pump when the vacuum pump is viewed from the front side.

FIG. 2 is a partially cross-sectional view of the side portion of the vacuum pump 1, and FIG. 3 is a diagram showing the vacuum pump 1 of FIG. 2 when the vacuum pump 1 is viewed from the front side (the right side in FIG. 2). In FIG. 3, members such as a pump cover 24, a side plate 26, etc. are removed to show the construction of a cylinder chamber S. In the following description, the directions indicated by arrows at the upper portions of FIGS. 2 and 3 represent the up-and-down, front-and-rear and right-and-left directions of the pump 1 front-and-rear direction is also referred to as an axial direction, and the right-and-left direction is also referred to as a width direction.

As shown in FIG. 2, the vacuum pump 1 has an electrically operated motor (driving machine) 10 and a pump main body 20 which is actuated by the electrically operated motor 10 as a driving source. The electrically operated motor 10 and the pump main body 20 are fixedly mounted in the vehicle body of the car or the like while integrally joined to each other.

The electrically operated motor 10 has an output shaft (rotating shaft) 12 extending from substantially the center of one end portion front end) of a case 11 having a substantially cylindrical shape to the pump main body 20 side (front side). The output shaft 12 functions as a driving shaft for driving the pump main body 20, and rotates around the rotational center X1 extending in the front-and-rear direction. The tip portion 12A of the output shaft 12 is designed in the form of a spline shaft, and is engaged with spline grooves 27D formed at a part of a shaft hole 27A penetrating in the axial direction of a rotor 27 of the pump main body 20, whereby the output shaft 12 and the rotor 27 are joined to each other so as to be rotatable integrally with each other.

When the electrically operated power 10 is powered on by a power source (not shown), the output shaft 12 rotates in the direction of an arrow R (counterclockwise) in FIG. 3, whereby the rotor 27 is rotated in the same direction (in the direction of the arrow R) around the rotational center X1.

The case 11 is integrally configured to have a case main body 60 formed in a cylindrical shape having a bottom, and a cover body 61 which blocks the opening of the case main body 60. The case main body 60 is formed so that the peripheral edge portion 60A thereof is folded to the outside. The cover body 61 has a disc portion (wall surface) 61A which is formed to have substantially the same diameter as the opening of the case main body 60, a cylindrical portion 61B which is continuous with the peripheral edge of the disc portion 61A and fitted to the inner peripheral surface of the case main body 60, and a crook portion 61C formed by crocking the peripheral edge of the cylindrical portion 61B outwards. The disc portion 61A and the cylindrical portion 61B intrude into the case main body 60, and the crook portion 61C is fixed in contact with the peripheral edge portion 60A of the case main body 60. Accordingly, one end portion (front end) of the case 11 is concaved inwards, whereby the electrically operated motor 10 is provided with a fitting cavity portion 63 in which the pump main body 20 is fixed in a spigot-fitting fashion.

Furthermore, a penetration hole 61D through which the output shaft 12 penetrates, and an annular bearing holder 61E which is formed around the penetration hole 61D so as to extend to the inside of the case main body 60 are formed substantially at the center of the disc portion 61A. The outer wheel of the bearing 62 which pivotally supports the front side of the output shaft 12 is held on the inner peripheral surface 61F of the bearing holder 61E.

As shown in FIG. 2, the pump main body 20 has a casing main body 22 which is fitted in the fitting cavity portion 63 formed at the front side of the case 11 of the electrically operated motor 10, a cylinder liner 23 which is disposed in the casing main body 22 and forms a cylinder chamber S, and a pump cover 24 which covers the casing main body 22 from the front side thereof. In this embodiment, the casing main body 22 and the cylinder liner 23 are provided to constitute the casing 31 of the vacuum pump 1.

The casing main body 22 is formed of metal material having high thermal conductivity such as aluminum or the like so that the shape thereof in front view is vertically long and substantially rectangular with the rotational center X1 being substantially the center of the casing main body 22 as shown in FIG. 3. An intercommunication hole 22A intercommunicating with the inside of the cylinder chamber S provided in the casing main body 22 is formed at the upper portion of the casing main body 22, and a suction nipple 30 is pressed in the intercommunication hole 22A. As shown in FIG. 2, the suction nipple 30 is a straight pipe extending upwards, and a pipe or tube for supplying negative-pressure air from external equipment (for example, the vacuum tank 7 (see FIG. 1)) is connected to one end 30A of the suction nipple 30.

A hole portion 22B based on an axial center X2 extending in the front-and-rear direction is formed in the casing main body 22, and the cylindrically-designed cylinder liner 23 is integrally provided in the hole portion 22B. Specifically, molten metal is poured in a mold under the state that the cylinder liner 23 is set in the mold, whereby the casing main body 22 (casing 31) is casted integrally with the cylinder liner 23. The axial center X2 is parallel to the rotational center Xl of the output shaft 12 of the electrically operated motor described above, and eccentrically shifted obliquely to the upper left side from the rotational center Xl as shown in FIG. 2. In this construction, the axial center X2 is eccentrically shifted so that the outer peripheral surface 27B of the rotor 27 formed around the rotational center Cl comes into contact with the inner peripheral surface 23A of the cylinder liner 23 formed around the axial center X2.

The cylinder liner 23 is formed of the same metal material as the rotor 27 (iron in this embodiment), and for example, surface hardening such as hard chrome plating or the like is conducted on the inner peripheral surface 23A of the cylinder liner 23, thereby enhancing the hardness of the inner peripheral surface (sliding surface) 23A.

In this embodiment, the casing main body 22 is casted while integrated with the cylinder liner 23, whereby the cylinder liner 23 can be accommodated within the length range of the casing main body 22 in the front-and-rear direction. Therefore, the cylinder liner 23 can be prevented from protruding from the casing main body 22, and thus the casing main body 22 can be miniaturized.

Furthermore, the casing main body 22 is formed of material having higher thermal conductivity than the rotor 27. According to this construction, heat generated when the rotor 27 and vanes 28 are rotated can be rapidly transferred to the casing main body 22, so that heat can be sufficiently radiated from the casing main body 22.

An opening (intake hole) 23B through which the intercommunication hole (intake hole) 22A of the casing main body 22 intercommunicates with the inside of the cylinder chamber S is formed in the cylinder liner 23, and air passing through the suction nipple 30 is passed through the intercommunication hole 22A and the opening 23B and supplied into the cylinder chamber S. Exhaust holes 22C, 23C which penetrate through the casing main body 22 and the cylinder liner 23 and through which air compressed in the cylinder chamber S is discharged are provided to the lower portions of the casing main body 22 and the cylinder liner 23. In this embodiment, the intercommunication hole 22A, the opening 23B and the exhaust holes 22C and 23C are arranged on the same axial center line so as to sandwich the cylinder chamber S therebetween. For example, they can be formed by only one drill processing from the upper surface side of the casing main body 22.

Side plates 25, 26 which block the openings of the cylinder chamber S are arranged at the rear and front ends of the cylinder liner 23. These side plates 25, 26 are configured to have a larger diameter than the inner diameter of the inner peripheral surface 23A of the cylinder liner 23, and urged by wave washers 25A, 26A to be pressed against the front and rear ends of the cylinder liner 23. Accordingly, the hermetically sealed cylinder chamber S is formed inside the cylinder liner 23 except for the opening 23B intercommunicating with the suction nipple 30 and the exhaust holes 23C, 22C. Seal rings may be provided in place of the wave washers 25A, 26B.

The rotor 27 is disposed in the cylinder chamber S. The rotor 27 is configured in a cylindrical shape so as to extend along the rotational center X1 of the electrically operated motor 10, and has a shaft hole 27A in which the output shaft 12 as the driving shaft of the pump main body 20 is inserted. Furthermore, plural guide grooves 27C are provided to the rotor 27 so as to be radially away from the shaft hole 27A and spaced from one another at equal angular intervals in the peripheral direction. Spline grooves 27D to be fitted to the spline shaft provided to the tip portion 12A of the output shaft 12 are formed at a part of the shaft hole 27A, whereby the rotor 27 and the output shaft 12 are joined to each other in a spline joint manner.

In this embodiment, a cylindrical recess portion 27F which is larger in diameter than the shaft hole 27A is formed around the shaft hole 27A on the front end face of the rotor 27, and a push nut 70 is secured to the tip of the output shaft 12 extending in the recess portion 27F. The movement of the rotor 27 to the tip side of the output shaft 12 is regulated by the push nut 70.

The length in the front-and-rear direction of the rotor 27 is set to be substantially equal to the length of the cylinder chamber S of the cylinder liner 23, that is, the distance between the confronting inner surfaces of the two side plates 25, 26, and the rotor 27 and each of the side plates 25, 26 are substantially occluded.

Furthermore, as shown in FIG. 3, the outer diameter of the rotor 27 is set so that a minute clearance is kept between the outer peripheral surface 27B of the rotor 27 and a portion of the inner peripheral surface 23A of the cylinder liner 23 which is located at the lower right position. Accordingly, a crescentic space is formed in the space between the outer peripheral surface 27B of the rotor 27 and the inner peripheral surface 23A of the cylinder liner 23 in the cylinder chamber S compartmented by the side plates 25, 26.

The rotor 27 is provided with plural (five in this embodiment) vanes 28 through which the crescentic space is partitioned. The vane 28 is designed like a plate, and the length in the front-and-rear direction thereof is set to be substantially equal to the distance between the confronting inner surfaces of the two side plates 25, 26 as in the case of the rotor 27. These vanes 28 are disposed in the guide grooves 27C provided to the rotor 27 so as to freely protrude/recede from/into the guide grooves 27C provided to the rotor 27. Each vane 28 protrudes outwards along the guide groove 27C by centrifugal force in connection with rotation of the rotor 27, and the tip thereof comes into contact with the inner peripheral surface 23A of the cylinder liner 23. Accordingly, the crescentic space described above is partitioned into five compression chambers P surrounded by the respective two adjacent vanes 28, 28, the outer peripheral surface 27B of the rotor 27 and the inner peripheral surface 23A of the cylinder liner 23. These compression chambers P rotate in the same direction as the rotor 27 in connection with the rotation in the direction of the arrow R of the rotor 27. The volume becomes larger in the neighborhood of the opening 23B and smaller at the exhaust hole 23C. That is, through the rotation of the rotor 27 and the vanes 28, air sucked from the opening 23B into one compression chamber P is compressed while rotated in connection with the rotation of the rotor 27, and discharged from the exhaust hole 23C. In this construction, the rotation compression element is configured to have the rotor 27 and the plural vanes 28.

In this construction, the cylinder liner 23 is integrally incorporated in the casted casing main body 22 so that the axial center X2 of the cylinder liner 23 is eccentric to the upper left side obliquely from the rotational center X1 as shown in FIG. 2. Therefore, a large space can be secured in the opposite direction to the eccentric direction of the cylinder liner 23 in the casing body 22, and an expansion chamber 33 which intercommunicates with the exhaust holes 23C, 22C is formed along the peripheral edge portion of the cylinder liner 23 in this space.

The expansion chamber 33 is formed as a large closed space extending along the peripheral edge portion of the cylinder liner 23 from the lower side of the cylinder liner 23 to the upper side of the output shaft 12, and intercommunicates with an exhaust port 24A formed in the pump cover 24. Compressed air flowing into the expansion chamber 33 expands and disperses in the expansion chamber 33, impinges against the partition wall of the expansion chamber 33 and irregularly reflects from the partition wall. Accordingly, the sound energy of the compressed air is attenuated, whereby noise and vibration during exhausting can be reduced.

The pump cover 24 is disposed on the front side plate 26 through the wave washer 26A, and fixed to the casing main body 22 by a bolt 66. As shown in FIG. 3, a seal groove 22D is formed on the front surface of the casing main body 22 so as to surround the cylinder liner 23 and the expansion chamber 33, and an annular seal member 67 (FIG. 2) is disposed in the seal groove 22D. The pump cover 24 is provided with an exhaust port 24A at the position corresponding to the expansion chamber 33. The exhaust port 24A serves to discharge air flowing into the expansion chamber 33 to the outside of the machine (to the outside of the vacuum pump 1). The exhaust port 24A is provided with a check valve 29 for preventing back-flow of air from the outside of the machine into the pump.

Furthermore, the vacuum pump 1 is constructed by joining the electrically operated motor 10 and the pump main body 20, and the rotor 27 and the vanes 28 which are joined to the output shaft 12 of the electrically operated motor 10 move slidingly in the cylinder liner 23 of the pump main body 20. Therefore, it is important to assemble the pump main body 20 in conformity with the rotational center X1 of the output shaft 12 of the electrically operated motor 10.

Therefore, in this embodiment, the fitting cavity portion 63 is formed at the one end side of the casing 11 of the electrically operated motor 10 with the rotational, center X1 of the output, shaft 12 set as the center thereof. Furthermore, a cylindrical fitting portion 22F projecting rearwards is integrally formed around the cylinder chamber S on the back surface of the casing main body 22 as shown in FIG. 2. The fitting portion 22F is formed concentrically with the rotational center X1 of the output shaft 12 of the electrically operated motor 10, and the outer diameter of the fitting portion 22F is set so that the fitting portion 22F is fitted in the fitting cavity portion 63 of the electrically operated motor 10 in a spigot joint manner. Accordingly, in this construction, the center positions can be simply matched with each other by merely fitting the fitting portion 22F of the casing main body 22 in the fitting cavity portion 63 of the electrically operated motor 10, and the work of assembling the electrically operated motor 10 and the pump main body 20 can be easily performed. Furthermore, the seal groove 22E is formed on the back surface of the casing main body 22 so as to surround the fitting portion 22F, and the annular seal member 35 is disposed in the seal groove 22E.

Figure 4:
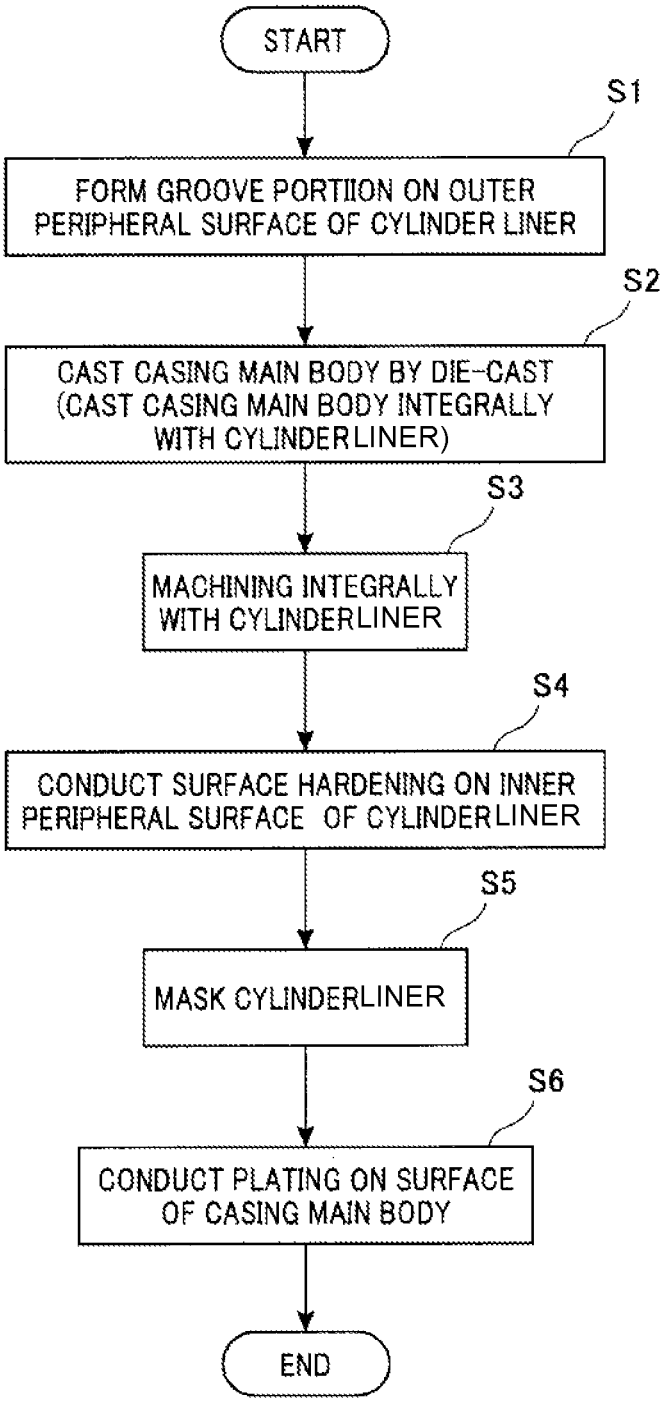
FIG. 4 is a flowchart showing the process of manufacturing a casing.
Figure 5:
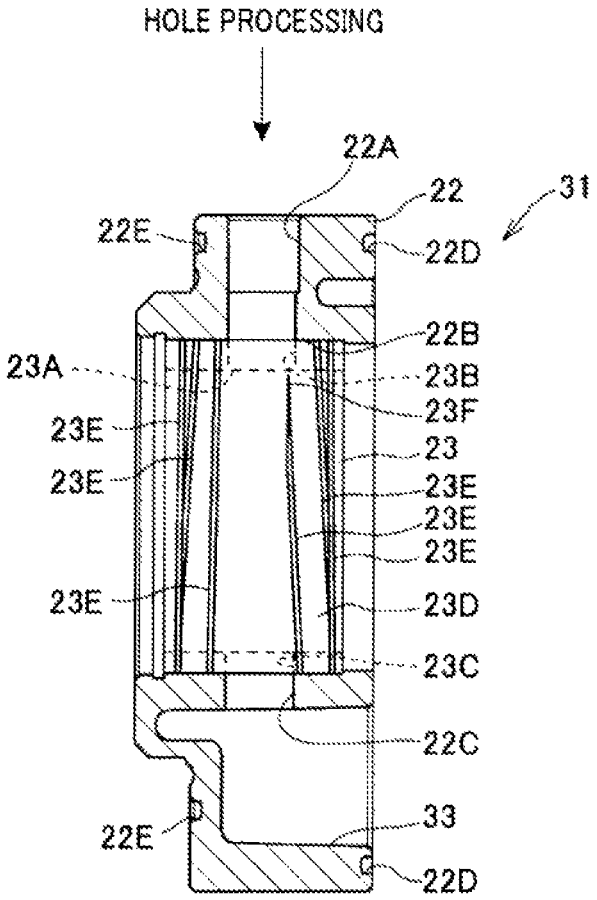
FIG. 5 is a partially cross-sectional view of the side portion of the vacuum pump, which shows spiral grooves formed on the outer peripheral surface of the cylinder liner to prevent rotation and dropout.

Next, a method of manufacturing the casing 31 having the vacuum pump 1 described above will be described. FIG. 4 is a flowchart showing the manufacturing process of the casing 31.

First, spiral grooves (means for preventing rotation and dropout) are formed on the outer peripheral surface of the cylinder liner 23 used in the casing 31 (step S1). Specifically, plural spirally-extending groove portions 23E are formed on the outer peripheral surface 23D of the cylinder liner 23. Molten metal intrudes into the groove portions 23E when the molten metal is poured to the cylinder liner 23, and the groove portions 23E function as anchors, whereby the cylinder liner 23 is prevented from rotating and dropping off. It is preferable to form the groove portions 23E while the end portion 23F is closed, and the pitch between the groove portions 23E may be changed. The spirally extending groove portions 23E can be simply formed by applying a blade (cutting tool) to the outer peripheral surface 23D of the cylinder liner 23 under the state that the cylinder liner 23 is held on a lathe chuck. The pitch of the groove portions 23E can be simply changed by adjusting the feeding amount of the cylinder liner 23. In this embodiment, from the viewpoint of the easy shape formation, the spirally extending groove portions 23E are formed on the outer peripheral surface 23D of the cylinder liner 23. However, the present invention is not limited to the spirally extending groove portions. For example, uneven portions such as dimples or the like may be processed on the outer peripheral surface 23D of the cylinder liner 23.

Subsequently, the casing main body 22 is casted in a mold under the state that the cylinder liner 23 is incorporated in the mold (step S2). Specifically, the cylinder liner 23 is set in a metal mold for die-casting (not shown), and under this state, molten metal (liquid metal) of aluminum or the like is poured into the metal mold, whereby the casing main body 22 is casted while the cylinder liner 23 is integrally incorporated in the casted casing main body.

Subsequently, the cylinder liner 23 and the casing main body 22 are integrally subjected to machining (step S3). Specifically, the intercommunication hole 22A as the intake hole and the opening 23B of the cylinder liner are integrally processed, and the exhaust hole 22C of the casing main body 22 and the exhaust hole 23C of the cylinder liner 23 are integrally processed. In this embodiment, the intercommunication hole 22A, the opening 23B and the exhaust holes 22C, 23C are arranged on the same axial center so as to sandwich the cylinder chamber S therebetween. Therefore, they can be formed by only one drilling work from the upper surface side of the casing main body 22. After the processing of these holes, burr occurring around the intercommunication hole 22A, the opening 23B and the exhaust holes 22C, 23C is removed.

The inner peripheral surface 23A of the cylinder liner 23 functions as the sliding surface on which the rotor 27 and the vanes 28 slide, and thus the cylinder liner 23 is required to be formed with high precision so as to have an accurate inner diameter. In this embodiment, the casing main body 22 is casted integrally with the cylinder liner 23. Therefore, in the casting process, the cylinder liner 23 comes into contact with the high-temperature molten metal, so that it thermally expands and then thermally shrinks in a cooling step. Accordingly, there is a risk that the inner diameter of the cylinder liner 23 are different among individuals. Therefore, the inner diameter of the cylinder liner 23 is accurately matched with a specified dimension by cutting the inner peripheral surface 23A of the cylinder liner 23 which is integrated with the casted casing main body 22.

Subsequently, a surface treatment is conducted to coat the inner peripheral surface 23A of the cylinder liner 23 with metal which is harder than the cylinder liner 23 (iron) (step S4). Specifically, the inner peripheral surface 23A of the cylinder liner 23 is subjected to hard chrome plating. In this case, masking is conducted on the casing main body 22 except for the inner peripheral surface 23A of the cylinder liner 23, and then the whole casing main body is immersed in a chrome plating tank to subject the inner peripheral surface 23A to hard chrome plating. After dried, the inner peripheral surface 23A is subjected to buffing or the like to accurately match the inner diameter of the cylinder liner with a specified dimension.

Finally, masking is conducted on the cylinder liner 23 (step S5), the surface of the casing main body 22 is subjected to trivalent zinc plating (step S6), and then the processing is finished.

As described above, according to this embodiment, the method of manufacturing the casing 31 having the cylinder chamber S in which the rotor 27 and the vanes 28 driven by the electrically operated motor 10 slide, comprises a step of disposing the cylinder liner 23 forming the cylinder chamber S in a mold and casting the casing main body 22 by using molten metal of aluminum while integrating the cylinder liner 23 with the casted casing main body 22, and a step of processing the intercommunication hole 22A, the opening 23B and the exhaust holes 22C, 23C which penetrate through both the cylinder liner 23 and the casing main body 22 together and intercommunicate with the cylinder chamber S. Accordingly, the intercommunication hole 22A, the opening 23B and the exhaust holes 22C, 23C can be processed so as to penetrate integrally through the cylinder liner 23 and the casing main body 22 casted integrally with the cylinder liner 23, and intercommunicate with the cylinder chamber S. Therefore, there can be eliminated the work of adjusting the hole positions between the cylinder liner 23 and the casing main body 22, which occurs in the step of pressing the cylinder liner into the casing main body 22, and the additional step of the casing main body. Therefore, as compared with the case where the cylinder liner is pressed into the casing main body 22, the number of working steps in the manufacturing process can be reduced. Furthermore, the casing 31 is manufactured while the cylinder liner 23 is integrally incorporated in the casted casing main body 22, and thus the casing 31 can be iniaturized in the axial direction thereof.

Furthermore, according to this embodiment, the hard chrome plating is conducted on the inner peripheral surface 23A of the cylinder liner in which the opening 23B and the exhaust hole 23C are processed. Therefore, the sliding surface having high hardness can be simply formed even in the casing 31 in which the cylinder liner 23 is integrally incorporated in the casted casing main body 22.

Still furthermore, according to this embodiment, the step of forming the means for preventing rotation and dropout of the cylinder liner 23 on the outer peripheral surface 23D of the cylinder liner 23 is provided prior to the step of casting the casing main body 22 integrally with the cylinder liner 23. Therefore, even when metals different in thermal expansion coefficient are adopted for the cylinder liner 23 and the casing main body 22, the construction of preventing the rotation and dropout of the cylinder liner 23 from the casing main body 22 can be more greatly simplified as compared with the construction that the cylinder liner is pressed into the casing main body 22.

Still furthermore, according to this embodiment, the spiral groove portions 23E are formed on the outer peripheral surface 23D of the cylinder liner 23 as the means for preventing rotation and dropout. Therefore, the cylinder liner 23 which is prevented from rotating and dropping out can be created readily.

Still furthermore, according to this embodiment, in the vacuum pump 1 having the casing 31 containing therein the cylinder chamber S in which the rotor 27 and the vanes 28 driven by the electrically operated motor 10 moves slidingly, the casing 31 has the cylinder liner 23 with which the casing main body 22 is casted integrally to form the cylinder chamber S, and also has the intercommunication hole 22A, the opening 23B and the exhaust holes 22C, 23C which penetrate integrally through the cylinder liner 23 and the casing main body 22 and intercommunicate with the cylinder chamber S. Therefore, the casing 31 can be miniaturized in the rotational axis direction, and also the number of working steps in the manufacturing process can be more greatly reduced as compared with the case where the cylinder liner is pressed in.

The best mode for carrying out the present invention has been described above. However, the present invention is not limited to the above embodiment, and various modifications and alterations can be made on the basis of the technical idea of the present invention.

DESCRIPTION OF REFERENCE NUMERALS

1 vacuum pump
10 electrically operated motor (driving machine)
12 output shaft (rotating shaft)
22 casing main body
22B hole portion
22C exhaust hole
23A inner peripheral surface
23B opening (intake hole)
23C exhaust hole
23D outer peripheral surface
23E groove portion (spiral groove)
23F end portion
24 pump cover
27 rotor (rotational compression element)
28 vane (rotational compression element)
31 casing
S cylinder chamber

The invention claimed is:

1. A method of manufacturing a casing having a cylinder chamber in which a rotational compression element driven by a driving machine slides, comprising:

a step of disposing a cylinder liner forming the cylinder chamber in a mold, and casting a casing main body by using molten metal while integrally incorporating the cylinder liner in the casted casing main body; and a step of processing an intercommunication hole and an exhaust hole that penetrate through the cylinder liner and the casing main body together and intercommunicate with the cylinder chamber, the processing of the intercommunication hole and the exhaust hole being a single machining process performed from a side surface of the casing main body, wherein the single machining process is performed from an upper surface side of the casing main body, such that the intercommunication hole and the exhaust hole are arranged on a same axial center line so as to sandwich the cylinder chamber.

2. The method of manufacturing the casing according to claim 1, further comprising a step of coating harder metal than the cylinder liner on an inner peripheral surface of the cylinder liner in which the intake hole and the exhaust hole are processed.

3. The method of manufacturing the casing according to claim 1, further comprising a step of forming means for preventing rotation and dropout of the cylinder liner on an outer peripheral surface of the cylinder liner prior to the step of casting the casing main body integrally with the cylinder liner.

4. The method of manufacturing the casing according to claim 3, wherein a spiral groove is formed on the outer peripheral surface of the cylinder liner as the means for preventing the rotation and the dropout.

5. The method of manufacturing the casing according to claim 1, wherein the cylinder liner is casted in the casing main body so that an axial center of the cylinder liner is eccentric to a rotational center.

* * * * *